US011707123B2

(12) United States Patent
Bell et al.

(10) Patent No.: US 11,707,123 B2
(45) Date of Patent: Jul. 25, 2023

(54) STOWABLE TABLE

(71) Applicants: Michael Bell, Sisters, OR (US); Glen K. Van Peski, Bend, OR (US)

(72) Inventors: Michael Bell, Sisters, OR (US); Glen K. Van Peski, Bend, OR (US)

( * ) Notice: Subject to any disclaimer, the term of this patent is extended or adjusted under 35 U.S.C. 154(b) by 0 days.

(21) Appl. No.: 17/906,550

(22) PCT Filed: Mar. 19, 2021

(86) PCT No.: PCT/US2021/023319
§ 371 (c)(1),
(2) Date: Sep. 16, 2022

(87) PCT Pub. No.: WO2021/188997
PCT Pub. Date: Sep. 23, 2021

(65) Prior Publication Data

US 2023/0128123 A1 Apr. 27, 2023

Related U.S. Application Data

(60) Provisional application No. 62/992,079, filed on Mar. 19, 2020.

(51) Int. Cl.

| | |
|---|---|
| ***A45C 13/28*** | (2006.01) |
| ***A47B 23/06*** | (2006.01) |
| ***A45C 9/00*** | (2006.01) |

(52) U.S. Cl.
CPC ..... *A45C 13/28* (2013.01); *A45C 9/00* (2013.01); *A47B 23/06* (2013.01)

(58) Field of Classification Search
CPC ..... A45C 13/28; A45C 9/00; A47B 23/06
See application file for complete search history.

(56) References Cited

U.S. PATENT DOCUMENTS

| | | | | |
|---|---|---|---|---|
| 7,364,129 | B1 * | 4/2008 | Levari, Jr. | A47G 23/0216 108/4 |
| 8,955,656 | B1 * | 2/2015 | Foster | A45C 5/03 108/17 |
| 9,381,932 | B1 * | 7/2016 | Giamanco | A45C 13/262 |
| 10,285,495 | B1 * | 5/2019 | Valme | A47B 13/081 |
| 10,561,234 | B1 * | 2/2020 | von Goins | A47B 23/06 |
| 11,457,727 | B1 * | 10/2022 | Weber | A47B 3/10 |
| 2004/0251289 | A1 * | 12/2004 | Chretien | G09F 7/18 224/411 |

(Continued)

*Primary Examiner* — Tri M Mai
(74) *Attorney, Agent, or Firm* — Alleman Hall Creasman & Tuttle LLP

(57) ABSTRACT

A stowable table mountable to a handle of luggage is disclosed. In an example, the stowable table includes a rigid or semi-rigid main panel, a pair of flap portions mounted to a first side of the main panel, and a first restraint system mounted to the first side of the main panel between the pair of flap portions to secure the main panel to a handle grip of the handle. Each flap portion has a folding axis relative to the main panel that is spaced apart from the folding axis of the other flap portion to define a region that accommodates the handle between the pair of flap portions. The stowable table further includes a second restraint system that tensions the pair of flap portions toward each other, and spans the distance between the pair of flap portions on each side of the region to surround the handle.

20 Claims, 4 Drawing Sheets

(56) References Cited

U.S. PATENT DOCUMENTS

| | | | | |
|---|---|---|---|---|
| 2006/0243768 | A1* | 11/2006 | Dowell | B60R 11/00 224/400 |
| 2008/0054149 | A1* | 3/2008 | Freebairn | F16M 11/2092 248/346.02 |
| 2008/0134946 | A1* | 6/2008 | Alonso | A45C 9/00 108/50.11 |
| 2010/0236884 | A1 | 9/2010 | Brown | |
| 2016/0022032 | A1 | 1/2016 | Simon | |
| 2016/0113388 | A1 | 4/2016 | Distefano | |

* cited by examiner

STOWABLE TABLE

CROSS REFERENCE TO RELATED APPLICATIONS

This application claims priority to International Patent Application Serial No. PCT/US2021/023319 filed on Mar. 19, 2021, which claims priority to and the benefit of U.S. provisional patent application Ser. No. 62/992,079, filed Mar. 19, 2020, the entirety of which is hereby incorporated herein by reference for all purposes.

BACKGROUND

Luggage, such as roller bags, are commonly used by travelers. Many roller bags or other forms of luggage utilize a telescoping handle that allows a person to extend the handle to conveniently pull the roller bag or luggage while walking or stow the handle to minimize the size of the roller bag or luggage. Some roller bags and other forms of luggage are sized to be within a size threshold defined by airline standards and certifications for stowage in an overhead compartment.

SUMMARY

A stowable table mountable to a handle of a roller bag or other forms of luggage is disclosed. According to an example, the stowable table includes a rigid or semi-rigid main panel, and a pair of flap portions mounted to a first side of the main panel. Each flap portion has a folding axis relative to the main panel that is spaced apart from the folding axis of the other flap portion of the pair by a distance to define a region that accommodates the handle of the roller bag between the pair of flap portions. The stowable table further includes a first restraint system mounted to the first side of the main panel between the pair of flap portions to secure the main panel to a handle grip of the handle. The stowable table further includes a second restraint system that tensions the pair of flap portions toward each other, and spans the distance between the pair of flap portions on each side of the region to surround the handle grip and/or one or more arms of the handle connecting the handle grip to the roller bag.

DETAILED DESCRIPTION

Figure 1:
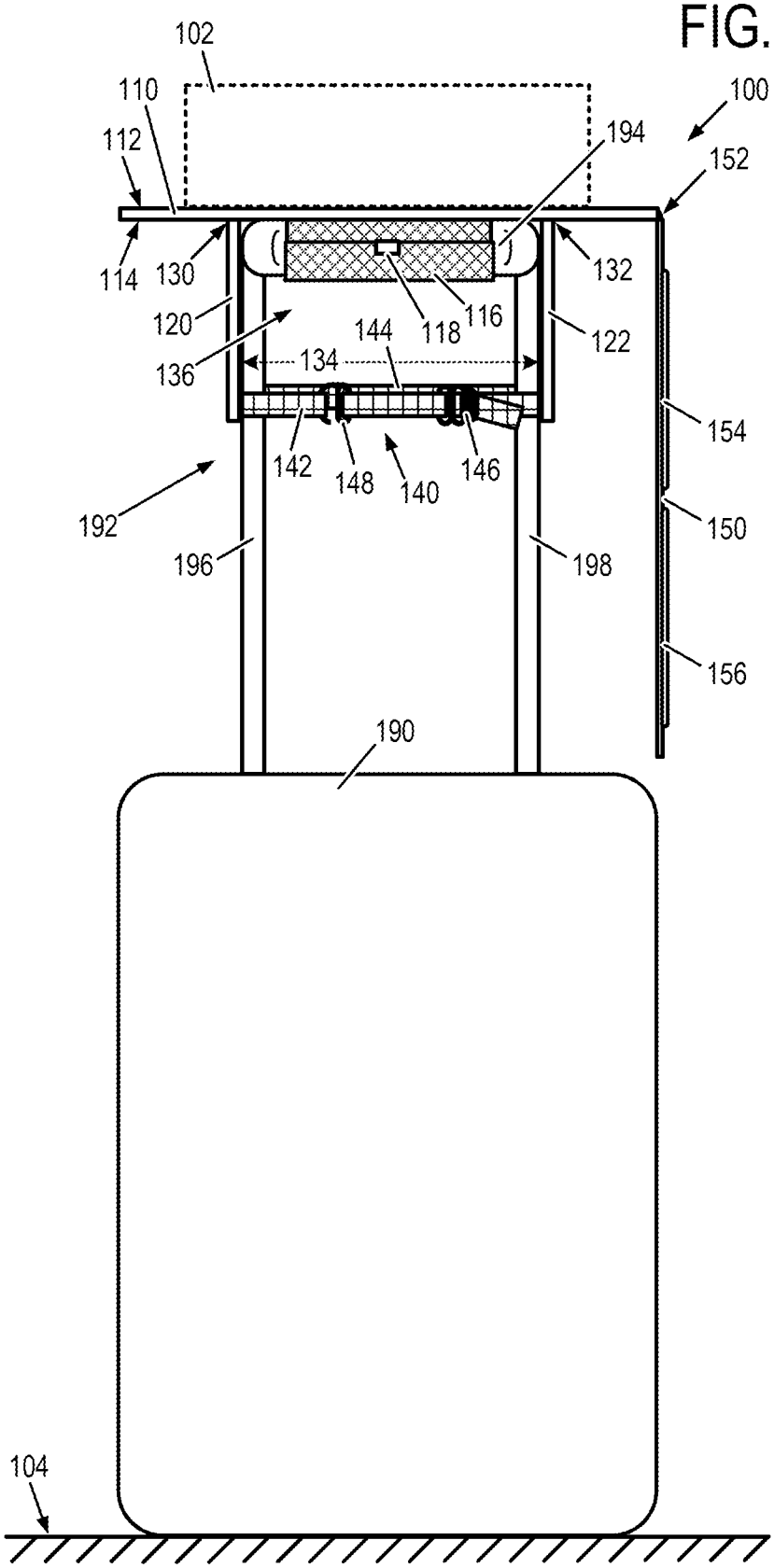
FIG. 1 shows an example of a stowable table mounted to a roller bag.

FIG. 1 shows an example of a stowable table 100 mounted to a roller bag 190. While roller bag 190 is used as an example, it will be understood that the configurations and techniques described herein can be used with other forms of luggage or with other objects that have handles or similarly shaped structures. In this example, stowable table 100 is mounted to a handle 192 of roller bag 190 that is resting on a floor or ground surface 104. Handle 192 in this example includes a handle grip 194 that is connected to roller bag 190 by telescoping arms 196 and 198 of the handle. However, other suitable handle configurations may be used.

Stowable table 100 includes a rigid or semi-rigid main panel 110 that provides a work surface 112 that can be used to support one or more objects represented schematically at 102. Such objects may include a personal computer (e.g., laptop, tablet, smartphone, etc.), a notepad, a book, magazine, food item, beverage item, game board, playing cards, etc. The terms rigid or semi-rigid are used to denote a feature of the main panel in which the main panel is capable of supporting at least its own weight (and potentially the weight of additional objects) while orientated in a horizontal orientation relative to the gravity vector.

Stowable table 100 includes a pair of flap portions 120 and 122 mounted to a rear side 114 of main panel 110 opposite work surface 112. Each flap portion has a folding axis relative to main panel 110 indicated schematically at 130 and 132 for flap portions 120 and 122, respectively. The folding axis of each flap portion is spaced apart from the folding axis of the other flap portion of the pair by a distance 134 to define a region 136 that accommodates handle 192 of the roller bag between the pair of flap portions 120 and 122.

Stowable work table 100 includes a first restraint system 116 mounted to rear side 114 of main panel 110 between the pair of flap portions 120 and 122 to secure the main panel to handle grip 194. In the example depicted in FIG. 1, first restraint system 116 takes the form of a tubular wrap or strap that includes hook and loop (e.g., Velcro), and further includes a tab 118 that aids in separating opposing ends of the strap from each other. The tubular wrap or strap of first restraint system 116 may be static or elastic, depending on fastening technique. In another example, first restraint system 116 may include a clip or other suitable strap utilizing a snap, clip, or other suitable fastener to secure the first restraint system to the handle grip.

Stowable table 100 includes a second restraint system 140 that tensions the pair of flap portions 120 and 122 toward each other. In this example, restrain system 140 spans distance 134 between the pair of flap portions on each side of region 136 to surround handle grip 194 and/or one or more arms (e.g., 196 and 198) connecting the handle grip to roller bag 190. As shown in FIG. 1, second restraint system 140 passes in front of arms 196 and 198 on a front side as indicated at 142, and passes behind arms 196 and 198 on a rear side as indicated at 144. In an example, second restraint system 140 takes the form of one or more strap portions, and may further include a buckle portion 146 that enables a length of the one or more strap portions to be adjusted to tighten or loosen the restraint system, and a clasp portion 148 (e.g., a hook, a clip, etc.) that enables opposing ends of the one or more strap portions to be connected and disconnected from each other. Strap portions of second restraint system 140 may be static or elastic, depending on implementation. Buckle portion 146 and/or clasp portion 148 may be omitted in at least some examples, such as where hook and loop (e.g., Velcro) is used. It will be appreciated that second restraint system 140 may take other suitable forms. For example, second restraint system 140 may include a first strap that secures flap portion 120 to arm 196, and a second strap (e.g., separate from the first strap) that secures flap portion 122 to arm 198. In this alternative example, the straps may take the form of a hook and loop (e.g., Velcro) strap or a belt with buckle or clasp that is passed around a respective arm of the handle.

In at least some examples, stowable table 100 may further include a cover portion 150 forming a flap or panel that joins main panel 110 along a first perimeter edge 152 of the main panel. As described in further detail with reference to FIG. 4, cover portion 150 folds along first perimeter edge 152 to cover the pair of flap portions 120 and 122 folded against main panel 110 in a stowed configuration. While first perimeter edge 152 is shown along a right-hand edge of main panel 110 in FIG. 1, in other examples first perimeter edge may be located along a left-hand edge, a rear edge, or a front edge of main panel 110. Cover portion 150 may include one or more pockets or sleeves for stowing objects, such as indicated schematically at 154 and 156. Some examples may include one or more additional flaps or panels that join the main panel along another perimeter edge of the main panel as compared to cover portion 150. These additional flaps or panels can include additional pockets or sleeves for stowing objects.

Figure 2:
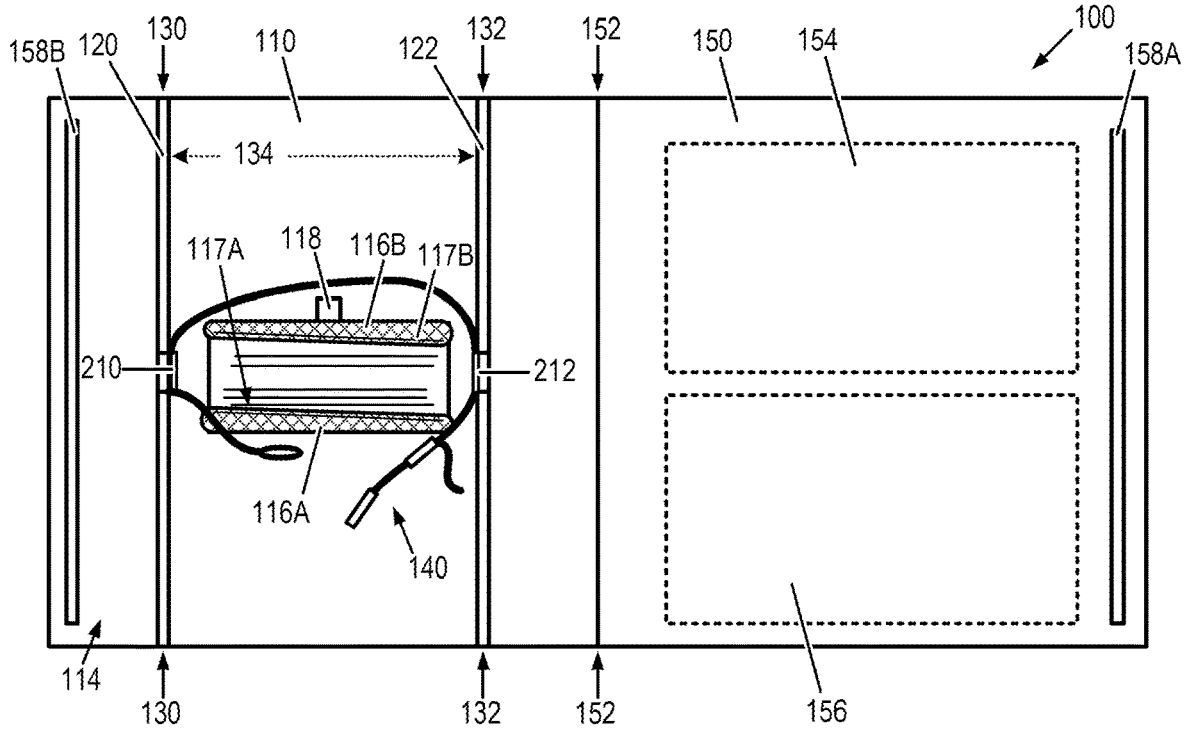
FIG. 2 shows the stowable table of FIG. 1 in a first configuration in which the stowable table is unfolded.

FIG. 2 shows stowable table 100 in a first configuration from rear side 114 in which the stowable table is unfolded. In the example of FIG. 2, flap portions 120 and 122 project out of the page. FIG. 2 depicts an example in which folding axes 130 and 132 are parallel to each other. FIG. 2 further depicts an example in which straps of second restraint system 140 pass through loops 210 and 212 of flap portions 120 and 122, respectively. Straps of second restraint system 140 may alternatively be sewn or permanently secured to flap portions 120 and 122, respectively. FIG. 2 further depicts opposing ends 116A and 116B of first restraint system 116 separated from each other, enabling the handle grip to be detached from the stowable table. Opposing ends 116A and 116B of first restraint system 116 may be wrapped around the handle grip and rejoined to secure the stowable table to the handle grip. As an example, first end 116A includes a first touch fastener 117A that forms a hook-side or a loop-side of a hook-and-loop fastener, and second end 116B includes a second touch fastener 117B that forms another of the hook-side or the loop-side of the hook-and-loop fastener relative to the first touch fastener. The first restraint system 116 can be mounted to the first side of the main panel between the first end and the second end of the tubular wrap. First touch fastener 117A (e.g., located on an exterior surface of the tubular wrap), and second touch fastener 117B (e.g., located on an interior surface of the tubular wrap) are positioned to engage with each other with the tubular wrap surrounding the handle grip to secure the main panel to the handle grip of the handle.

FIG. 2 further shows a first touch fastener 158A mounted on cover portion 150. In an example, the first touch fastener forms a hook-side or a loop-side of a hook-and-loop fastener. A second touch fastener 158B mounted on the first side of main panel 110. In an example, the second touch fastener forms another of the hook-side or the loop-side of the hook-and-loop fastener relative to first touch fastener 158A. First touch fastener 158A and second touch fastener 158B are positioned to engage with each other when the cover portion is folded against the main panel in the stowed configuration, such as depicted in FIG. 5.

Figure 3:
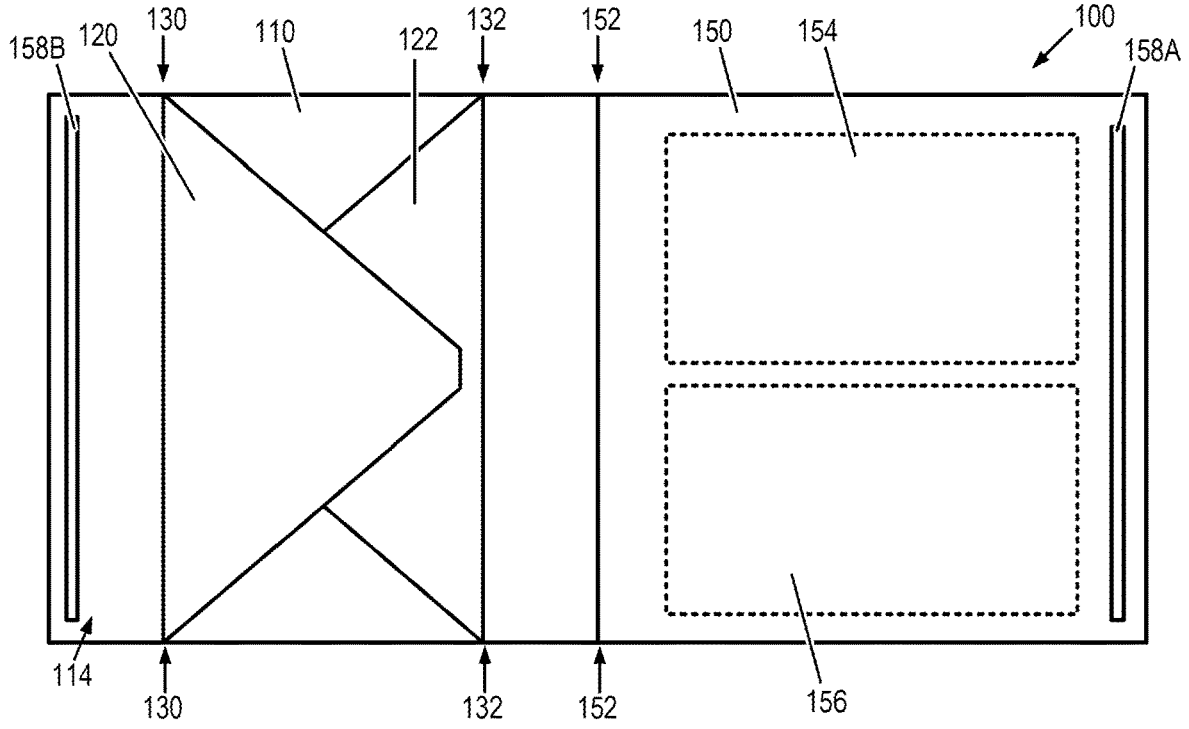
FIG. 3 shows the stowable table of FIG. 1 in a second configuration in which flap portions of the stowable table are folded inward.

FIG. 3 shows stowable table 100 in a second configuration from rear side 114 in which flap portions 120 and 122 are folded inward. In this example, the pair of flap portions 120 and 122 each fold toward each other along their respective folding axes 130 and 132 against main panel 110 and within an outer perimeter of the main panel to provide a stowed configuration. FIG. 3 also shows an example in which flap portions 120 and 122 have a triangular shape in which the most distal end of the flap portions has a flattened end, as opposed to a pointed tip. In an example, material that would otherwise form the pointed tip of the triangular shape may be folded back and stitched onto the flap portion to form loops 210 and 212, respectively.

Figure 4:
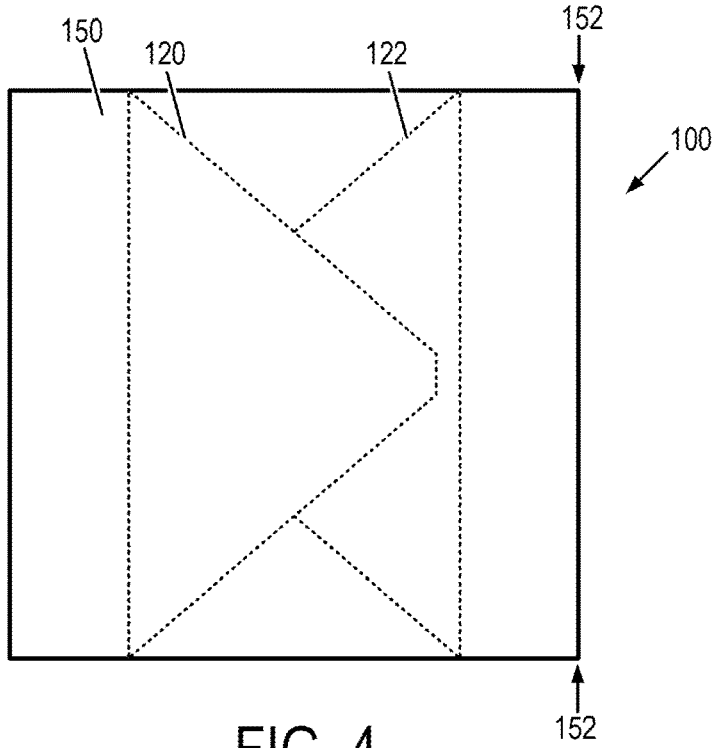
FIG. 4 shows the stowable table of FIG. 1 in a third configuration in which a cover portion is folded over the flap portions.

FIG. 4 shows stowable table 100 in a third configuration in which a cover portion 150 is folded along first perimeter edge 152 over the flap portions 120 and 122 (shown in broken lines to denote they are located beneath cover portion 150), and over main portion 110 (not shown). In this example, each perimeter edge of cover portion 150 generally aligns with a corresponding perimeter edge of main portion 110, and flap portions 120 and 122 are sandwiched between main portion 110 and cover portion 150, in the third configuration depicted in FIG. 4.

Figure 5:
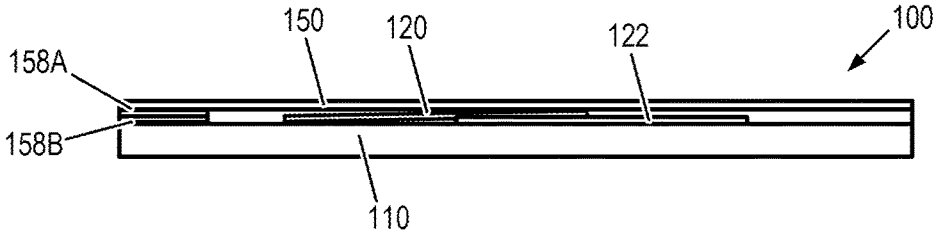
FIG. 5 shows the stowable table of FIG. 1 in the third configuration of FIG. 4 from another view.

FIG. 5 shows stowable table 100 in the third configuration of FIG. 4, but from a side view looking along first perimeter edge 152. The third configuration depicted in FIGS. 4 and 5 enables stowable table 100 to be stowed, such as within roller bag 190. For example, each dimension of stowable table 100 as depicted in FIG. 5 may be sufficiently sized to fit within roller bag 190 having an airline approved size for stowage in an overhead compartment. In at least some examples, cover portion 150 may be secured to main portion 110 along one or more perimeter edges to retain the stowable table in the stowed configuration, such as by a strap, button, hook and loop (e.g., Velcro), etc.

Figure 6:
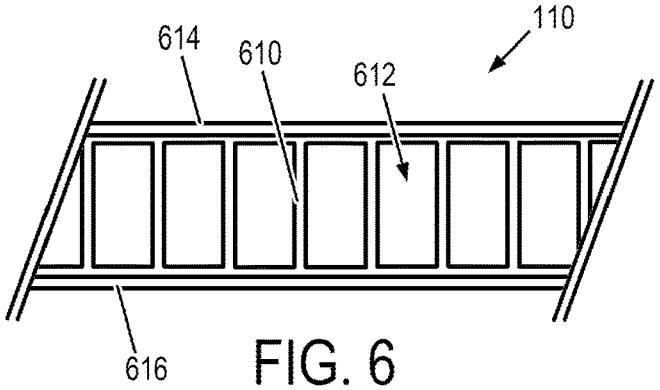
FIG. 6 shows an example cross section of a rigid or semi-rigid main portion of the stowable table of FIG. 1.

FIG. 6 shows an example cross section of the rigid or semi-rigid main portion 110 of stowable table 100. In this example, main portion 110 is formed from a rigid or semi-rigid corrugated panel core 610 (e.g., a corrugated plastic panel, corrugated foam core, etc.) having a plurality of channels 612, and a fabric (e.g., made of a nylon) or other textile exterior mounted on opposing sides of panel core 610 as indicated at 614 and 616. It will be understood that FIG. 6 depicts one example of main portion 110, and that other suitable configurations may be used, including a solid, non-corrugated panel core (e.g., foam core). Other portions of stowable table 100, such as flap portions 120 and 122, and cover portion 150 may be formed of the same fabric or other textile exterior indicated at 614 and 616. In an example, flap portions 120 and 122, and cover portion 150 may be sewn to or may be integrally formed from the fabric or other textile material of main portion 110.

In at least some examples, main panel 110 may be formed of two or more panels sections that are hinged to open up to create a table surface having a desired size and shape. In at least some examples, main panel 110 may be formed of two or more panel sections that slide together with or without a fastening mechanism, to create the desired size and shape of a table surface. In these or other examples, main panel 110 may be made rigid through attachment of beams or trusses that affix to the main panel by press fit, clip, sleeve, or other fastening technique.

Figure 7:
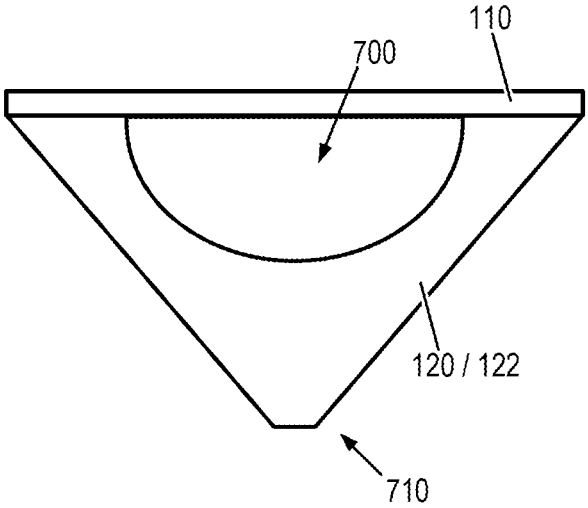
FIG. 7 depicts an example configuration of the flap portions.

FIG. 7 depicts an example configuration of flap portions 120 and 122.

In this example, flap portions 120 and 122 taper from the folding axis with the main panel toward a distal end of the flap portion. In at least some examples, flap portions 120 and 122 define an opening 700 between a distal end 710 of the flap portion and the folding axis of the flap portion. In the example depicted in FIG. 7, the opening in each flap portion has a semicircle or semioval shape. The opening in each flap portion can enable the flap portions to more easily fold flat with the main panel, as well as accommodating the first and second restraint systems disclosed herein.

According to an example of the present disclosure, a stowable table mountable to a handle of a roller bag or other form of luggage includes a rigid or semi-rigid main panel; a pair of flap portions mounted to a first side of the main panel, each flap portion having a folding axis relative to the main panel that is spaced apart from the folding axis of the other flap portion of the pair by a distance to define a region that accommodates the handle of the roller bag or other form of luggage between the pair of flap portions; a first restraint system mounted to the first side of the main panel between the pair of flap portions to secure the main panel to a handle grip of the handle; and a second restraint system that tensions the pair of flap portions toward each other, and spans the distance between the pair of flap portions on each side of the region to surround the handle grip and/or one or more arms of the handle connecting the handle grip to the roller bag or other form of luggage. In this example or other examples disclosed herein, the pair of flap portions can each fold toward each other along their respective folding axes against the main panel and within an outer perimeter of the main panel in a stowed configuration. In this example or other examples disclosed herein, the stowable table can further include a cover portion forming a flap or panel that joins the main panel along a first perimeter edge of the main panel; and wherein the cover portion folds relative to the main panel along the first perimeter edge to cover the pair of flap portions folded against the main panel in a stowed configuration. In this example or other examples disclosed herein, the stowable table can further include a first touch fastener mounted on the cover portion, the first touch fastener forming a hook-side or a loop-side of a hook-and-loop fastener; and a second touch fastener mounted on the first side of the main panel, the second touch fastener forming another of the hook-side or the loop-side of the hook-and-loop fastener relative to the first touch fastener; wherein the first touch fastener and the second touch fastener are positioned to engage with each other when the cover portion is folded against the main panel in the stowed configuration. In this example or other examples disclosed herein, the cover portion can include one or more pockets or sleeves for stowing objects. In this example or other examples disclosed herein, the cover portion can fold against the first side of the main panel and within an outer perimeter of the main panel in the stowed configuration. In this example or other examples disclosed herein, each flap portion can taper from the folding axis of the flap portion toward a distal end of the flap portion. In this example or other examples disclosed herein, an opening in each flap portion can be defined between a distal end of the flap portion and the folding axis of the flap portion. In this example or other examples disclosed herein, the opening in each flap portion can have a semicircle or semioval shape. In this example or other examples disclosed herein, the main panel can be formed by a rigid or semi-rigid core that is covered by a textile material. In this example or other examples disclosed herein, the core can be formed by a polymer material having a corrugated or honeycomb structure. In this example or other examples disclosed herein, the stowable table can further include a foam layer disposed between the core and the textile material of the main panel. In this example or other examples disclosed herein, each flap portion can be formed by a textile material that is stitched to the main panel. In this example or other examples disclosed herein, each flap portion can be further formed by a foam layer disposed between opposing outer layers formed by the textile material. In this example or other examples disclosed herein, the first restraint system can include a tubular wrap having: a first end that includes a first touch fastener that forms a hook-side or a loop-side of a hook-and-loop fastener, and a second end that includes a second touch fastener that forms another of the hook-side or the loop-side of the hook-and-loop fastener relative to the first touch fastener; the first restraint system can be mounted to the first side of the main panel between the first end and the second end of the tubular wrap; and the first touch fastener and the second touch fastener can be positioned to engage with each other with the tubular wrap surrounding the handle grip to secure the main panel to the handle grip of the handle. In this example or other examples disclosed herein, the tubular wrap can be formed by a textile that is mounted to the first side of the main panel by stitches along an axis that is orthogonal to the folding axes of the pair of flap portions. In this example or other examples disclosed herein, the second restraint system can include one or more strap segments; wherein a strap segment of the one or more strap segments is mounted to or passes through an opening formed at a distal end of each flap portion from the folding axis. In this example or other examples disclosed herein, a first end of the one or more strap segments can include a first connector, and a second end of the one or more strap segments can include a second connector configured to engage with the first connector. In this example or other examples disclosed herein, the first connector and the second connector can include a hook and a loop, a pair of clips, or a button and a button hole. In this example or other examples disclosed herein, the one or more strap segments can include a buckle that is adjustable to vary a level of tension provided by the pair of flap portions toward each other.

It will be understood that the configurations and/or techniques described herein are exemplary in nature, and that these specific examples are not to be considered in a limiting sense, because numerous variations are possible.

The invention claimed is:

1. A stowable table mountable to a handle of luggage, the stowable table comprising:

a rigid or semi-rigid main panel;

a pair of flap portions mounted to a first side of the main panel, each flap portion having a folding axis relative to the main panel that is spaced apart from the folding axis of the other flap portion of the pair by a distance to define a region that accommodates the handle between the pair of flap portions;

a first restraint system mounted to the first side of the main panel between the pair of flap portions to secure the main panel to a handle grip of the handle; and a second restraint system that tensions the pair of flap portions toward each other, and spans the distance between the pair of flap portions on each side of the region to surround the handle grip and/or one or more arms of the handle connecting the handle grip to the luggage.

2. The stowable table of claim 1, wherein the pair of flap portions each fold toward each other along their respective folding axes against the main panel and within an outer perimeter of the main panel in a stowed configuration.

3. The stowable table of claim 1, further comprising:

a cover portion forming a flap or panel that joins the main panel along a first perimeter edge of the main panel; and wherein the cover portion folds relative to the main panel along the first perimeter edge to cover the pair of flap portions folded against the main panel in a stowed configuration.

4. The stowable table of claim 3, further comprising:

a first touch fastener mounted on the cover portion, the first touch fastener forming a hook-side or a loop-side of a hook-and-loop fastener;

a second touch fastener mounted on the first side of the main panel, the second touch fastener forming another of the hook-side or the loop-side of the hook-and-loop fastener relative to the first touch fastener;

wherein the first touch fastener and the second touch fastener are positioned to engage with each other when the cover portion is folded against the main panel in the stowed configuration.

5. The stowable table of claim 3, wherein the cover portion includes one or more pockets or sleeves for stowing objects.

6. The stowable table of claim 3, wherein the cover portion folds against the first side of the main panel and within an outer perimeter of the main panel in the stowed configuration.

7. The stowable table of claim 1, wherein each flap portion tapers from the folding axis of the flap portion toward a distal end of the flap portion.

8. The stowable table of claim 1, wherein an opening in each flap portion is defined between a distal end of the flap portion and the folding axis of the flap portion.

9. The stowable table of claim 8, wherein the opening in each flap portion has a semicircle or semioval shape.

10. The stowable table of claim 1, wherein the main panel is formed by a rigid or semi-rigid core that is covered by a textile material.

11. The stowable table of claim 10, wherein the core is formed by a polymer material having a corrugated or honeycomb structure.

12. The stowable table of claim 10, further comprising:

a foam layer disposed between the core and the textile material.

13. The stowable table of claim 1, wherein each flap portion is formed by a textile material that is stitched to the main panel.

14. The stowable table of claim 1, wherein each flap portion is further formed by a foam layer disposed between opposing outer layers formed by the textile material.

15. The stowable table of claim 1, wherein the first restraint system includes a tubular wrap having:

a first end that includes a first touch fastener that forms a hook-side or a loop-side of a hook-and-loop fastener, and a second end that includes a second touch fastener that forms another of the hook-side or the loop-side of the hook-and-loop fastener relative to the first touch fastener; and wherein the first restraint system is mounted to the first side of the main panel between the first end and the second end of the tubular wrap;

wherein the first touch fastener and the second touch fastener are positioned to engage with each other with the tubular wrap surrounding the handle grip to secure the main panel to the handle grip of the handle.

16. The stowable table of claim 15, wherein the tubular wrap is formed by a textile that is mounted to the first side of the main panel by stitches along an axis that is orthogonal to the folding axes of the pair of flap portions.

17. The stowable table of claim 1, wherein the second restraint system includes one or more strap segments;

wherein a strap segment of the one or more strap segments is mounted to or passes through an opening formed at a distal end of each flap portion from the folding axis.

18. The stowable table of claim 17, wherein a first end of the one or more strap segments includes a first connector, and a second end of the one or more strap segments includes a second connector configured to engage with the first connector.

19. The stowable table of claim 18, wherein the first connector and the second connector include a hook and a loop, a pair of clips, or a button and a button hole.

20. The stowable table of claim 17, wherein the one or more strap segments include a buckle that is adjustable to vary a level of tension provided by the pair of flap portions toward each other.

* * * * *